US005586367A

United States Patent [19]

Benoit

[11] Patent Number: 5,586,367

[45] Date of Patent: Dec. 24, 1996

[54] HOOK CLOSURE FOR BOOT

[75] Inventor: Louis Benoit, La Balme de Sillingy, France

[73] Assignee: Salomon S.A., Metz-Tessy, France

[21] Appl. No.: 550,301

[22] Filed: Oct. 30, 1995

[30] Foreign Application Priority Data

Nov. 2, 1994 [FR] France ..... 94 13343

[51] Int. Cl.[6] ..... A43C 11/00

[52] U.S. Cl. ..... 24/68 SK; 24/68 CD; 24/270; 36/50.1; 285/409

[58] Field of Search ..... 24/68 SK, 68 CD, 24/270; 36/50.1; 285/409, 252, 365

[56] References Cited

U.S. PATENT DOCUMENTS

| | | | |
|---|---|---|---|
| 998,471 | 7/1911 | Dahlgren | 24/68 SK |
| 2,983,019 | 5/1961 | Rae | 36/50.1 |
| 3,009,221 | 11/1961 | Firari | 36/50.1 |
| 4,051,611 | 10/1977 | Chalmers | 24/68 SK |

FOREIGN PATENT DOCUMENTS

| | | | |
|---|---|---|---|
| 1685813 | 9/1971 | Germany . | |
| 3132042 | 5/1982 | Germany . | |
| 1054289 | 10/1981 | Italy . | |
| 186291 | 9/1985 | Italy . | |
| 0549898 | 12/1942 | United Kingdom | 24/270 |

*Primary Examiner*—Victor N. Sakran
*Attorney, Agent, or Firm*—Greenblum & Bernstein P.L.C.

[57] ABSTRACT

Simplified hook closure for a sport boot including an elastic means for returning into a position pressed against the shell of the boot. The hook closure has at least one element, such as a lever made out of flexible metal wire in the form of an open buckle whose lateral arms are of unequal lengths of a value "X", the curved ends of the said arms being affixed in corresponding holes formed on another element, such as a base, on which it is mounted. By virtue of the offset "X" of the curved ends of the element, any pivoting of the latter generates a certain elastic deformation of its arms, which automatically return to their initial position as soon as the lever is released thus assuring the elastic return function.

11 Claims, 7 Drawing Sheets

Fig- 13
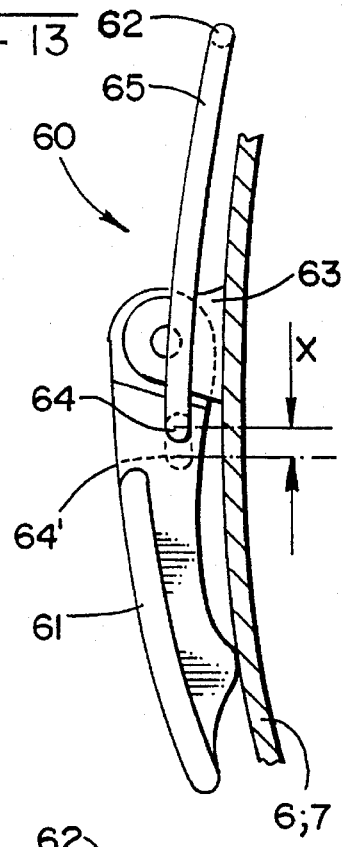
Fig- 12
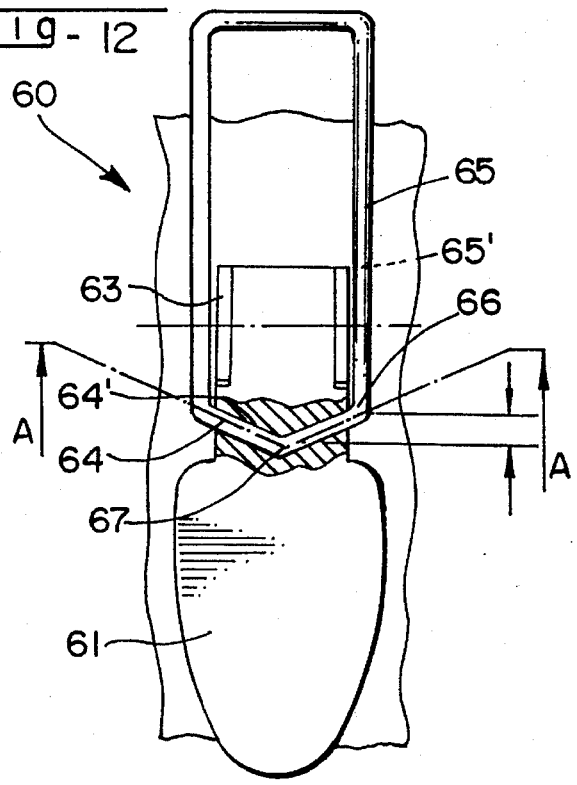
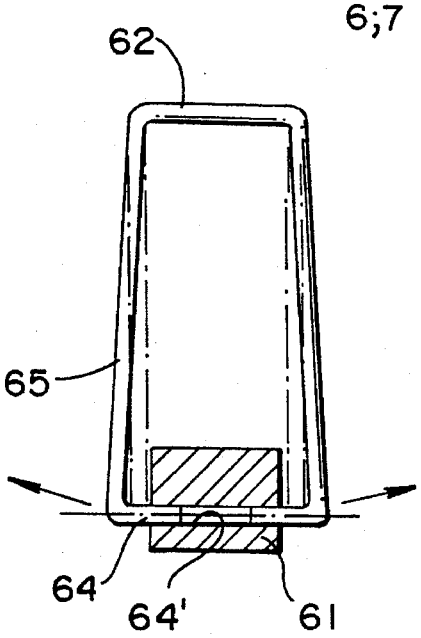
Fig- 14
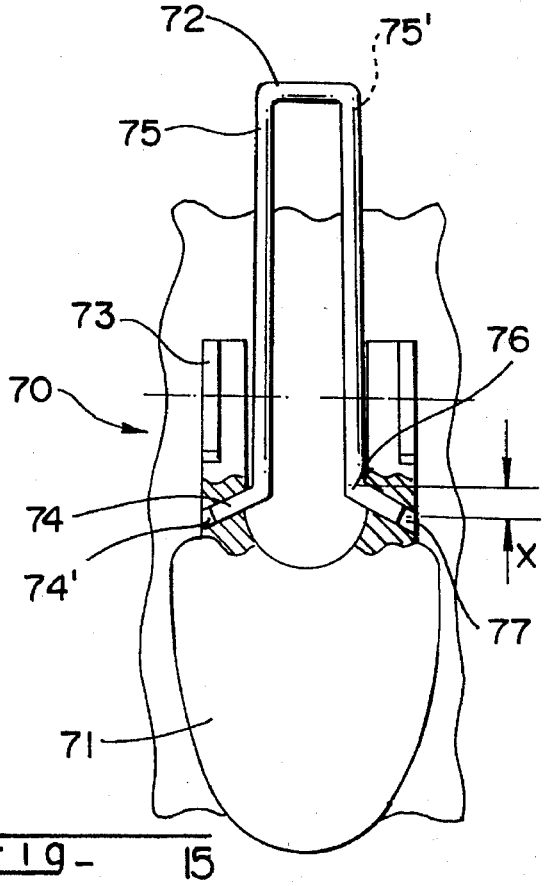
Fig- 15

HOOK CLOSURE FOR BOOT

FIELD OF THE INVENTION

The present invention relates to boot closures which are adapted to adjust the tightening of the upper and the shell on the foot, and more particularly "hook" type closures utilized on boots having a rigid or semi-rigid shell such as ski and mountain boots.

DESCRIPTION OF BACKGROUND AND RELEVANT INFORMATION

These closures having hooks generally comprise on one side a lever-puller carrying a buckle affixed to a base through an axis, on the other side a hooking element or hook for the lever buckle, both being able to be affixed either directly on the upper or the shell, or to the end of a flange or flap. Offering great facility of manipulation to open and close as well as a powerful tightening, these hook closures have been generally used in almost all ski boots having a shell. By virtue of this use on a board scale, these hook closures have been improved and certain of them have in particular been provided, among other improvements, with fine and coarse adjustment means, means for returning into a position pressed against the shell, and control lever-puller with constant lever arm.

By way of example, hook closures thus improved have been described in Italian patent 186,291 and U.S. Pat. No. 4,051,611. These documents describe closures which comprise, on a flange of the shell, a lever stretcher, a hooking buckle, a linkage tie rod positioned between the lever-puller and the said buckle, a return spring interacting between the tie rod and the lever-puller, and a base affixed on the corresponding flange of the shell of the boot, linkage axes affixing the lever-puller of the said base, and the tie rod of the lever-puller. An analogous hooking element having a rack constitutes the closure hook and is pivotably affixed on the other flange of the shell, such that the tightening force which is applied to its by the buckle when the lever is closed causes its alignment. In these closures, the tie rod is composed of two elements assembled to one another by a nut-bolt linkage to adjust micrometrically the active length of the tie rod; in this way, the coarse tightening adjustment occurs from "notch by notch" on the hooking element and the fine adjustment occurs micrometrically by screwing the elements of the tie rod to a greater or lesser degree.

Such hook closures are satisfactory because, on the one hand, the tightening force can be adjusted with precision without causing modification of the length of the lever-puller arm, and on the other hand, the lever-puller with its tie rod and its hooking buckle always and automatically return to a protective press down position against the shell when it has been opened by virtue of the return spring with which it is provided.

However, these closures have been found to be complex and therefore costly particularly since it is necessary to utilize a plurality of them on a single boot. Thus, as explained in U.S. Pat. No. 4,051,611, the possibility of reducing the number of closures by employing larger elements has been proposed. This solution, which necessitated a greater alignment precision between the hook and the buckle of each closure of the known prior art because none of the latter had the ability to be oriented in the direction of the tightening force, is nevertheless not satisfactory; indeed, the fact of broadening the constituent elements of the closure of U.S. Pat. No. 4,051,611 and affixing the hook or hooking element to the shell in a pivotable manner resolves only the problem of alignment and not that of the distribution of the load by the closure element over a greater portion of the shell of the boot, because the pivotable affixation means of the hooking element, itself, does not have an enlarged surface; it is the same for the affixation means of the cap of the lever-puller even though it is not pivotable.

Of course, there are more simple closures such as those described in Italian patent 1,054,289 but, in this case, the majority of improvements previously described, particularly the fine adjustment and the elastic return to the position pressed down against the shell of the boot do not exist. In effect, in this type of closure the lever-puller formed out of steel wire is directly hooked and journalled on a notched base and two lateral windings constituting the linkage bearings of the hooking buckle which is engaged in one of the notches of a rack type hook.

This type of closure is thus simple and inexpensive but without certain improvements, such as the return to the position pressed against the shell, which are the success of almost all of the know buckle closures.

SUMMARY OF THE INVENTION

The object of the present invention is to considerably reduce the cost of the closures to be used on a boot not by reducing their number or eliminating the improvements achieved, particularly the one concerning the automatic return of the closure to the protective position where it is pressed against the shell, but by simplifying the structure itself of the said closures.

Another object of the invention is to take advantage of the simplified structure of the closure to associate with it a covering or body which hides it, at least partially, or to confer to it a specific profile which integrates as well as possible with the shell of the boot on which it must be affixed. This arrangement likewise makes it possible, from a simplified base structure of the closure, to conceive a range of closures adapted to a range of boots.

According to the invention, the hook closure for the boot having a shell comprises on the one hand a control assembly provided with an elastic return means to the position pressed against the shell of the boot and is constituted by at least three elements such as a lever-puller, a hooking buckle, and a base, the lever-puller being connected to the base and the buckle to the lever-puller by journals, the buckle being able to be carried by an intermediate tie rod, and on the other hand, a hooking element or hook adapted to cooperate with the element constituting the buckle. At least one of the elements constituting the lever-puller and the buckle is made of a metallic wire in the form of an open buckle whose ends of the arms are curved top assure the linkage by journalling with the element on which it is mounted. This element made out of metallic wire is easy to manufacture, and thus inexpensive, and its curved ends replace a conventional journal utilizing an axis of rotation, which further simplifies the structure of the closure comprising it. Furthermore, by virtue of this simplified structure of the element made of metallic wire, a covering can easily by designed and adapted on it to hide at least partially its structure and/or match the hook closure comprising it with the boot model on which it is to be mounted.

The hook closure such as defined above is characterized by the fact that the elastic return means is integrated to one of its elements which is obtained in the form of an open buckle, which, formed out of flexible metallic wire, has two arms whose curved ends, longitudinally offset, are affixed in corresponding holes offset by the same amount and provided on the other element, thus constituting both the linkage by journalling between the element in the form of an open buckle and that on which it its mounted, and the elastic maintenance and return means thereof in their initial mounting position, for example pressed against the shell, such that a single element satisfies at least two functions previously achieved with two elements, one of these functions being that of the elastic return to the pressed down position.

According to one embodiment, the curved ends are longitudinally offset by virtue of the fact that the two arms of the elements of the hooked closure which comprise them are of unequal lengths.

According to another embodiment, at least one of the curved ends is longitudinally offset by virtue of its folding at an angle other than a right angle (90 degrees) with respect to the longitudinal axis of the arm of the element of the hook closure carrying it. Thus, the curved end is not perpendicular to the longitudinal axis of the arm. In a complimentary manner, the hole corresponding to this curved end, and provided on the other element, is then itself also offset by the same value and in the same direction as the folding of the said end, in the initial mounting position of the elements of the hook closure, for example pressed against the shell of the boot.

According to an alternative, the hook closure element comprising the curved ends longitudinally offset have both two arms of unequal lengths and at least one end curved at a different angle of 90 degrees with respect to the longitudinal axis of the arm which carries it.

In one embodiment, the element in the form of an open buckle is the lever-puller and the curved ends of the arms of the buckle constituting the elastic return means are affixed in corresponding holes formed in the base. The elastic return means then interact between the lever-puller and its base.

In another embodiment, it is the hooking buckle which is made in the form of an open buckle with its ends offset, which ends constitute the elastic return means. The offset ends are affixed in corresponding holes of the lever-puller formed at a distance from its journal on the base. The elastic means then interact between the hooking buckle and the lever-puller.

In the case of more complex hook closure, for example comprising an intermediate tie rod between the hooking buckle and the lever-puller, the tie rod can itself be formed as an open buckle out of flexible metallic wire and have two arms of unequal length whose curved ends are affixed in corresponding holes of the lever-puller to constitute the elastic return means of the tie rod with respect to the lever, and, consequently, of the buckle with respect to the latter.

BRIEF DESCRIPTION OF DRAWINGS

The invention will be better understood with reference to the annexed schematic drawings showing, by way of example, a plurality of embodiment of hook closures including the invention.

FIGS. 12–15 illustrate another embodiment of the elastic return means still according to the invention applied to a constituent element of a hook closure such as a buckle.

FIG. 12 is a partially exposed top view of the closure.

FIG. 13 is a side view, and FIG. 14 is a cross sectional view along A—A of FIG. 12, the buckle being in the raised position.

FIG. 15 shows another embodiment of the buckle.

DETAILED DESCRIPTION OF THE INVENTION

Figure 1:
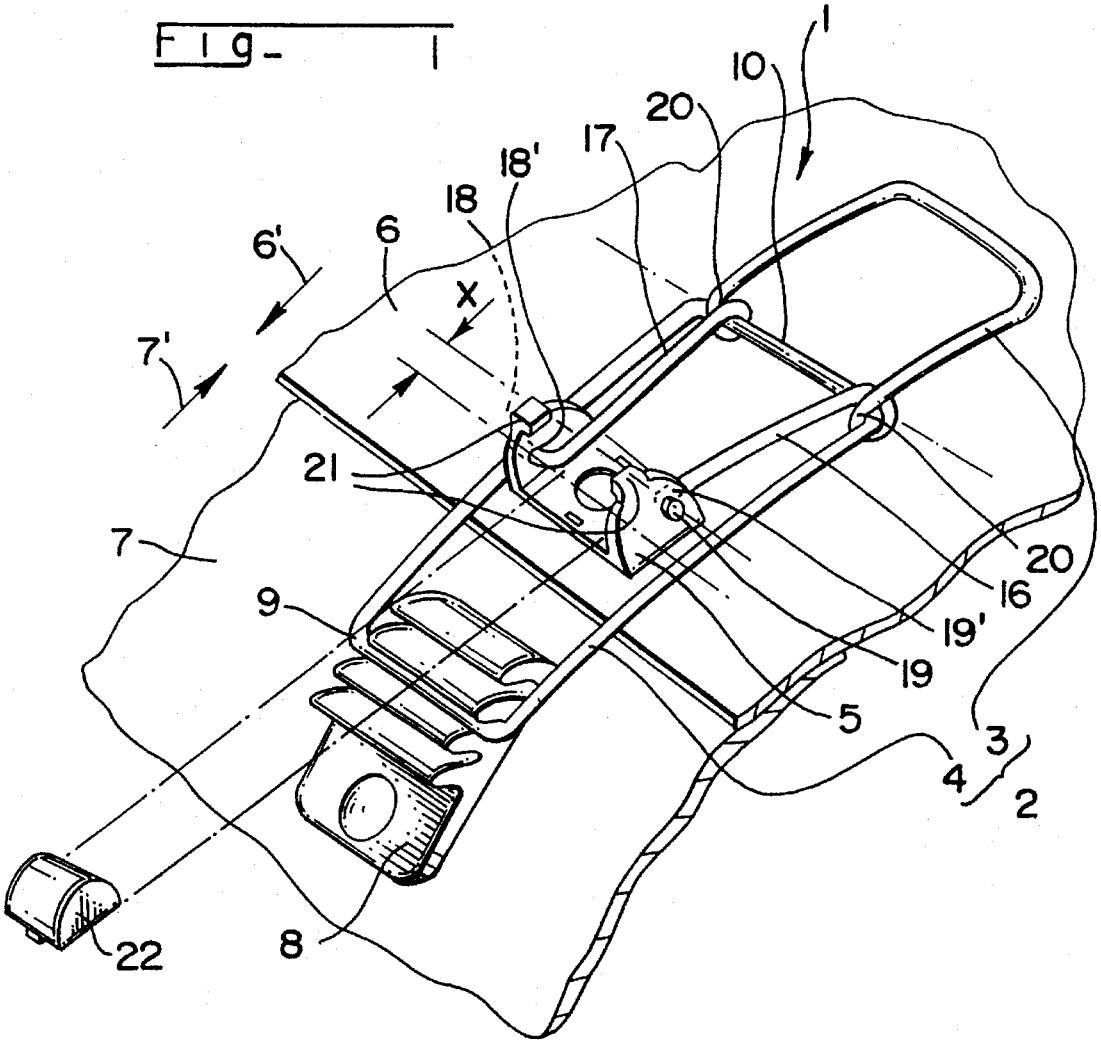
FIG. 1*a* is a cross-sectional view of a spacer for maintaining the arms of the lever in the offset holes shown in FIG. 1.
Figure 2:
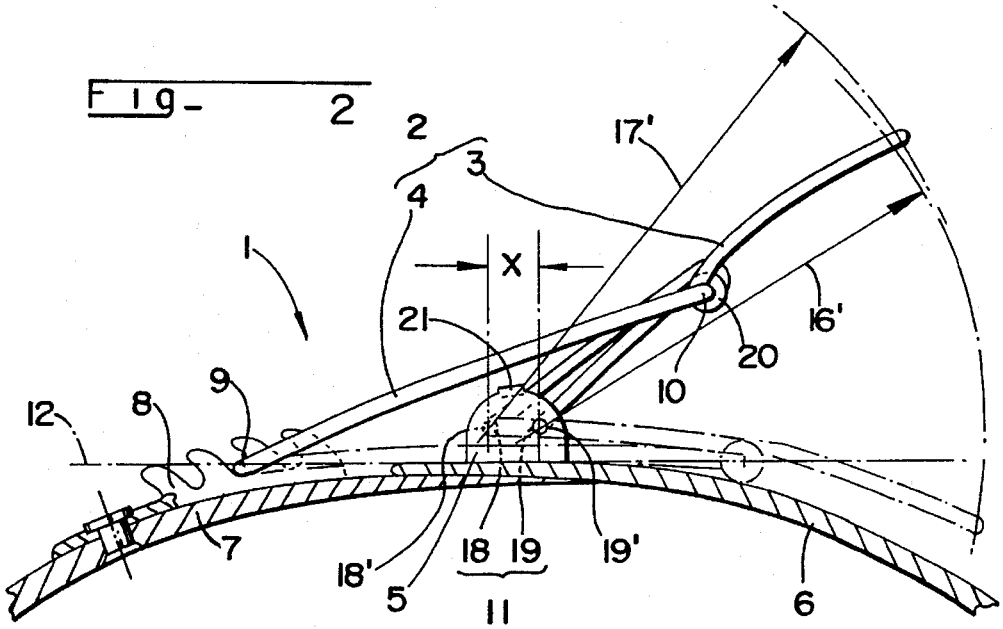
FIGS. 2 and 3 are elevational views of the hook closure of FIG. 1 showing schematically the operation of the elastic return means to the active position of the closure, FIG. 2, and the to the open position, FIG. 3.

In FIGS. 1 and 2 the hook closure 1 of the knuckle joint type is shown in the active position. In this position the control assembly 2 composed of a hooking buckle 4 and a lever-puller 3, mounted on base 5, is folded back against the flap 6 of the shell, and the buckle 4 is engaged through its end 9 in the hooking element 8, or hook, affixed to the other flap 7 of the shell. Under the pulling effect caused by lever-puller 3, the two flaps 6 and 7 are thus brought towards one another as shown by arrow 6' and 7' in the tightening position selected and maintained spaced apart in this position, the lever-puller 3 being applied against the flap 6 as soon as the equilibrium point of the knuckle joint is crossed. This equilibrium point is defined by the position of the two ends 9 and 10 of the hooking buckle 4 in alignment with the journal 11 of the lever-puller 3 on its base 5, it being understood that the end 9 is engaged in one of the teeth 14 of the hooking element 8; in fact, as soon as the plane 12 passing through ends 9 and 10 of the hooking buckle 4 engaged in one of the teeth 14 of hook 8 passes under journal 11, the lever-puller 3 is biased to be applied against the flap 6 by reaction to the spacing of the flaps 6 and 7, and conversely, as soon as the plane 12 passes above journal 11, the lever-puller 3 tends to open by elasticity of the said flaps 6 and 7 which return to their initial position.

Figure 3:
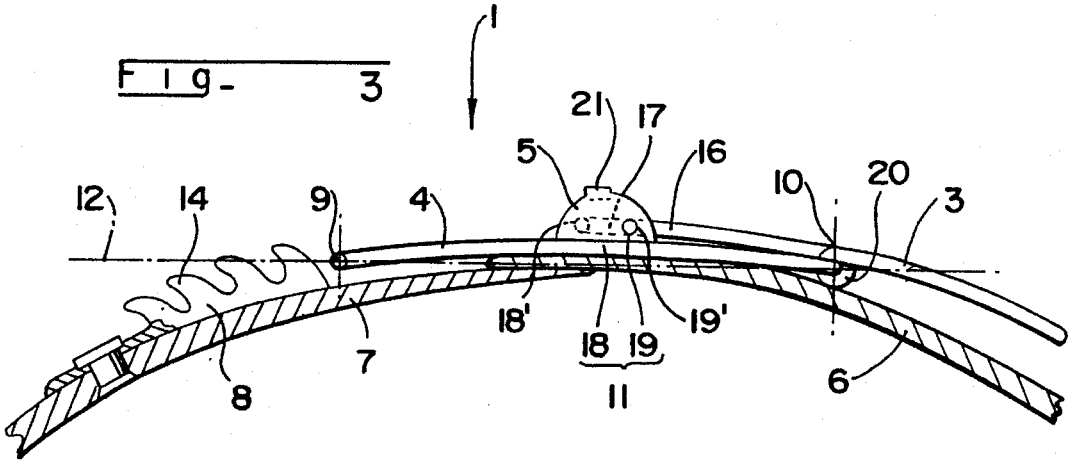

On the contrary, when the hook closure 1 is in the inactive position, FIG. 3, the knuckle joint no longer functions because the end 9 of the hooking buckle 4 is free; in this position the elasticity of the flaps thus no longer has any influence on the position of the lever-puller 3 which, in the absence of an elastic return means, could freely move back and forth on the exterior of the shell of the boot and be as a result easily damaged or caught. It is this disadvantage that the invention aims to resolve, and this, without adding a spring or supplemental element to those constituting the hook closure, but by integrating this return function to one of the said elements. In this example, it is the lever-puller 3 which is provided with this supplemental function. To this end, it is formed from a flexible metallic wire and has the general form of an open buckle whose two lateral arms 16 and 17 are of unequal length, of a value "X", their curved ends 18 and 19 being fixed in corresponding holes 18' and 19', formed in base 5, which are likewise offset as a function of the length of each arm 16 and 17.

Thus, by this arrangement where the ends 18 and 19 forming the journal 11 of the lever-puller 3 are offset, any pivoting of the lever 3 generates a certain elastic deformation of its lateral arms 16 and 17, with respect to one another, beginning at their ends 18 and 19, which serves as their pivot axis, and resulting from the difference of the circular trajectory 16' and 17', described by the said arms. As a result of the flexibility of the material constituting the lever 3, arms 16 and 17 of the latter thus deform elastically during the manual opening of the lever 3 and return it automatically to the position wherein it is pressed against the shell of the boot, or the flap 6, as soon as the hooking buckle 4 is disengaged from the hook 8 and that the lever 3 is released, as illustrated in FIG. 3.

As becomes clear, the return force and the possibility of back and forth movement of the lever-puller 3 for a given flexibility of the material constituting the latter are in correlation with the value of the offset "X" between the length of the two arms 16 and 17 of the lever 3. Thus, the greater the offset "X", the more substantial the elastic return force. On the contrary, the possible back and forth movement is thereby reduced. Conversely, if the offset "X" is small, the return force is relatively weak, but the possible back and forth movement is substantial. It is thus easy to play on this parameter "X" of the offset to construct and adapt the closure to the desired usage so as to avoid possible flip over or a too significant lifting of the lever-puller 3, which would cause the tearing away of the curved ends 18 and 19 out of holes 18' and 19', an abutment 21, for example two spurs, is provided on the base 5 and thus limits its back and forth movement.

Figure 1A:
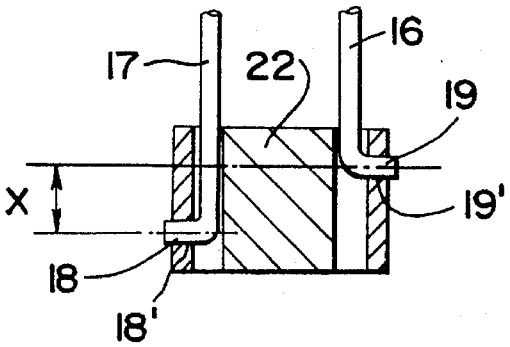

Likewise, the curved ends 18 and 19 can be firmly retained on base 3 by a means which prevents them from being lost, for example by affixing on the base 3 and between the ends 18 and 19, a spacer 22 as shown in FIG. 1*a;* in this way the curved ends 18 and 19 can no longer be pulled away from their attachment holes 18' and 19' in case of too significant lifting of the lever-puller 3.

In this embodiment the hook closure 1 is simplified to the maximum, and for this, the lateral arms 16 and 17 of the open buckle constituting the lever-puller 3 comprise two windings 20 serving as linkage bearings for the end 10 of the hooking buckle 4.

Figure 4:
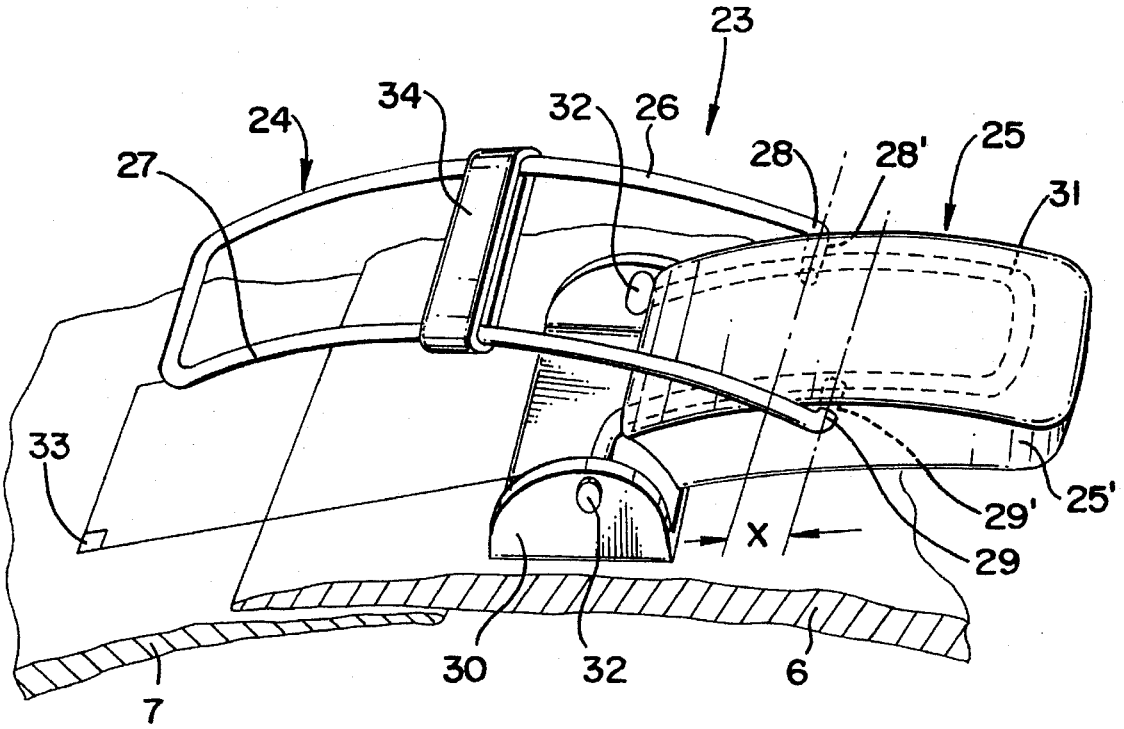
FIG. 4 illustrates another hook closure, of the knuckle joint type, whose hooking buckle is provided with elastic return means.

In another embodiment, as shown in FIG. 4, it is the hooking buckle 24 of the closure hook 23 which is provided with the function of elastic return of the lever-puller 25. To this end, the hooking buckle 24 is made out of a flexible metallic wire and has the form of an open buckle whose lateral arms 26 and 27 are of unequal lengths; their curved ends 28 and 29 are offset by a value "X" and are affixed in corresponding holes 28' and 29' obtained in the lever-puller 25. The lever-puller is affixed to its base 30 by means of a linkage formed with a U-shaped metallic pin whose curved ends 32 are on a single axis, which pin is retained in the body 25' of lever 25. The elastic return function of lever 25 is achieved in this embodiment by means of the hooking buckle 24 which, by returning to its initial position, i.e., substantially in the plane 33 of its ends 28 and 29, reassumes support on the shell of the boot and forces, by support reaction, the lever-puller 25 to press in turn against the flap 6 of the shell; the elastic means thus interacts between the hooking buckle 24 and the lever-puller 25. So as to avoid tearing away of the curved ends 28 and 29 of the hooking buckle 24 out of holes 28' and 29', a spacer 34, in the form of an inextendible ring is slid on the said buckle 24 and surrounds the arms 26 and 27.

Figure 5:
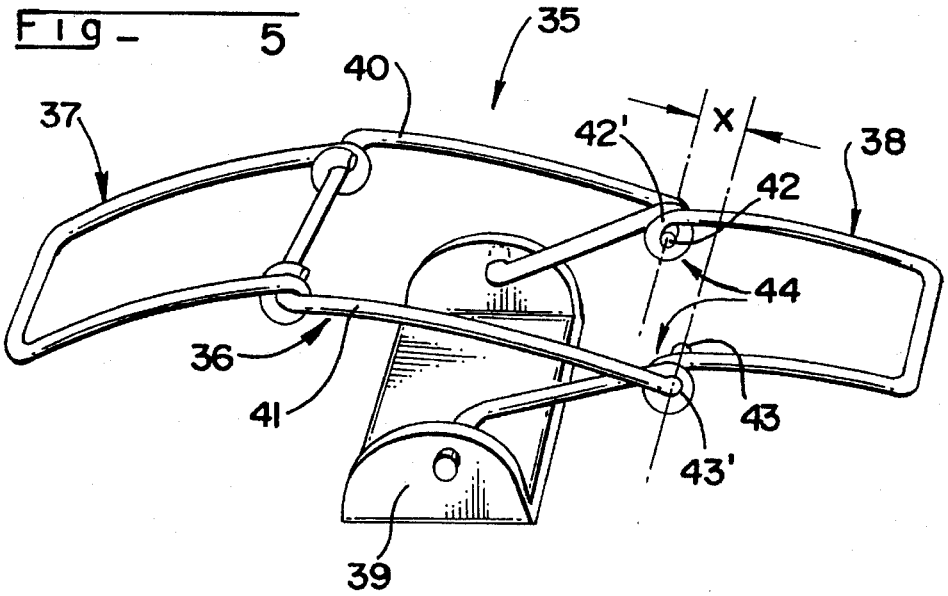
FIG. 5 illustrates another embodiment of the hooking buckle, which is connected to the lever-puller by a tie rod provided with the elastic return means.

In the case where an intermediate tie rod connects the hooking buckle to the lever-puller, it is possible to provide this tie rod with the elastic return function of the said lever-puller into the position pressed against the shell. That is what is shown in the case of FIG. 5 where the hook closure 35 has a plurality of elements such as a lever-puller 38, a tie rod 36, a hooking buckle 37, which are connected between them by journalling as well as the lever-puller 38 on its base 39. The tie rod 36 is formed in the shape of an open buckle whose two lateral arms 40 and 41 are of unequal length, of a value "X", their curved ends 42 and 43 being affixed in the corresponding holes 42' and 43' constituted by windings 44 of the metallic wire in which is formed the lever-puller 38. Of course, these windings 44 are off-centered by the same value "X" as the offset of the curved ends 42 and 43. The elastic return function of lever 38 is achieved as in the preceding case of FIG. 4, i.e., by support reaction of the tie rod 40 which carries the buckle 37 against the shell of the boot.

According to another embodiment illustrated in FIGS. 12–15, the elastic return function is achieved by virtue of the particular orientation given, on the one hand, to the folded portion of at least one of the curved ends 64, 74 of the elements 62, 72 of the hook closure 60, 70 carrying it, and on the other hand, to the hole 64', 74' of the corresponding base 63, 73 in which it is introduced and which is obtained on the other elements 61, 71 of the said closure. As shown, this orientation places the folded portion of the curved end 64, 74 along an angle which is not perpendicular to the longitudinal axis 65', 75' of the arm 65, 75 which carries it, i.e., at an angle different from a right angle (90 degrees), and likewise not perpendicular to the axis of rotation of the element 62, 72 considered of the hook closure. In fact, this orientation longitudinally offsets the curved end 64, 74 by a value "X" beginning at its fold 66, 76 up to its end 67, 77. As a result of these arrangements, any rotational bias of element 62, 72 around its end 64, 74 thus folded necessitates a certain force to cause the elastic deformation of the latter in the zone of their fold in flection and in torsion, which furnishes, as soon as the force ceases, a return energy of the element 62, 72 to the initial mounting position, for example pressed against the shell of the boot, either the flap 6 or 7 on which the hook closure 60, 70 is mounted.

It is evident that the folded portion of the curved end 64, 74 can come from arm 65 of an element 62 forming an half buckle "exterior" to the other element 61 on which it is mounted, such as is illustrated in the example of FIGS. 12–14 or conversely, come from arms 75 of an element 72 forming an half buckle interior to the other element 71, FIG. 15.

The embodiments which have just been described with reference to FIGS. 1–15 illustrate constructions in which the element 3, 4, 24, 25, 36, 37, 38, 62, 72 provided with the energy means at its ends offset by a value "X", either as a result of the fact that these two arms 16–17, 26–27, 40–41 are or unequal lengths, or as a result of the fact that at least one of the two arms 65, 75 has an end 64, 74 curved along an angle which is not perpendicular to the longitudinal axis 65', 75' of the arm 65, 75 which carries it. It is likewise possible to form constructions in which the curved ends of the element provided with the energy means are offset by a value "X" by combining the arms of unequal lengths with the curved ends oriented along an angle which is not perpendicular to the longitudinal axis of the said arms.

It is understood that the elastic return function obtained by virtue of the offset of the ends of a flexible metallic buckle and which can be achieved either at the level of the hooking buckle 4, 24 of its tie rod 36 or of the lever-puller 3, as just been described with reference to the examples of FIGS. 1–5, can be adapted to other hook closures, more or less sophisticated. By way of example, FIGS. 6, 7 and 8 illustrate such applications.

Figure 6:
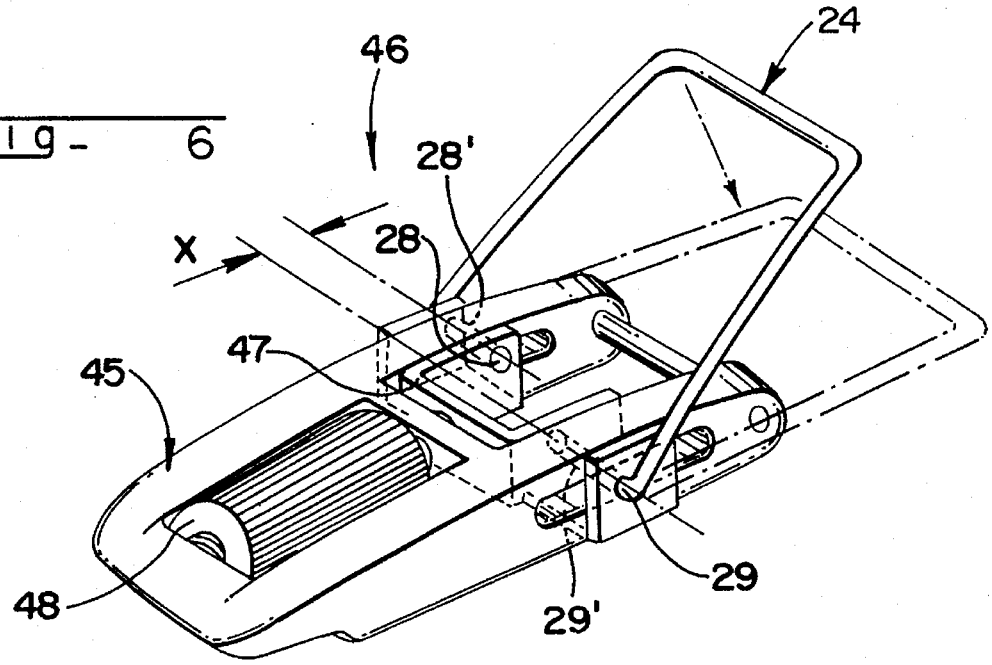
FIG. 6 is a perspective view of a hook closure of the knuckle joint type comprising a micrometric adjustment system on which is affixed a hooking buckle provided with the elastic return means, such as the buckle of FIG. 6.

In FIG. 6, the hook closure 46 comprising a lever-puller 45 provided with a slide 47 having micrometric adjustment activated by a wheel 48 can be equipped with a hooking buckle 24 are provided with the elastic return function.

Figure 7:
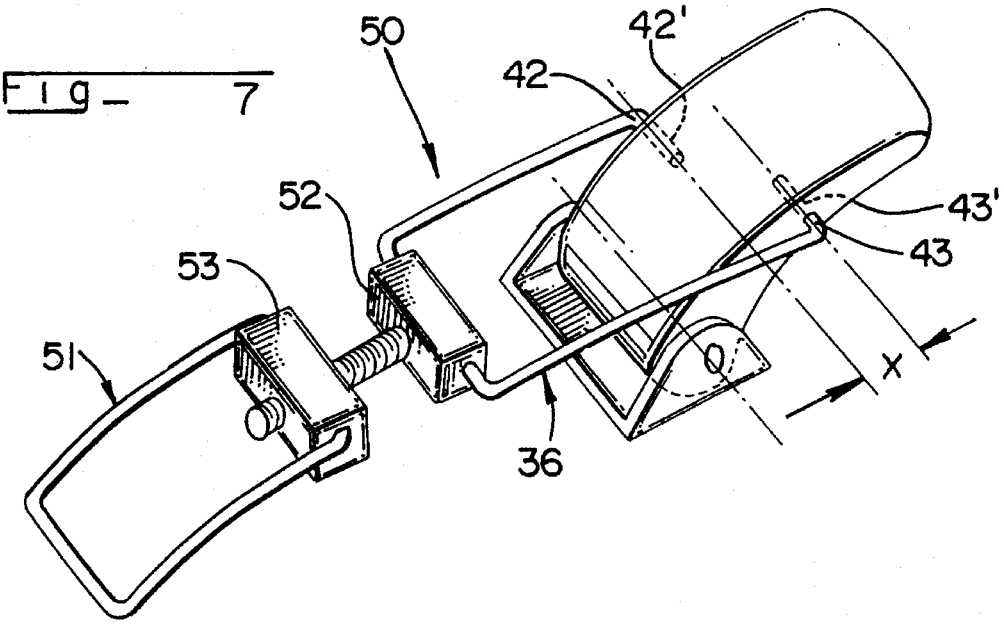
FIG. 7 illustrates in perspective view, a hook closure, of the knuckle joint type, comprising a micrometrically adjustable buckle tie rod and provided with return means interacting between the lever on the said buckle.

In FIG. 7, the hook closure 50 has a buckle 51 which is connected to a tie rod 36 constituting the elastic return means by means of a pair of bolt 52-nut 53 pair, allowing for micrometric adjustment of the pulling length.

Figure 8:
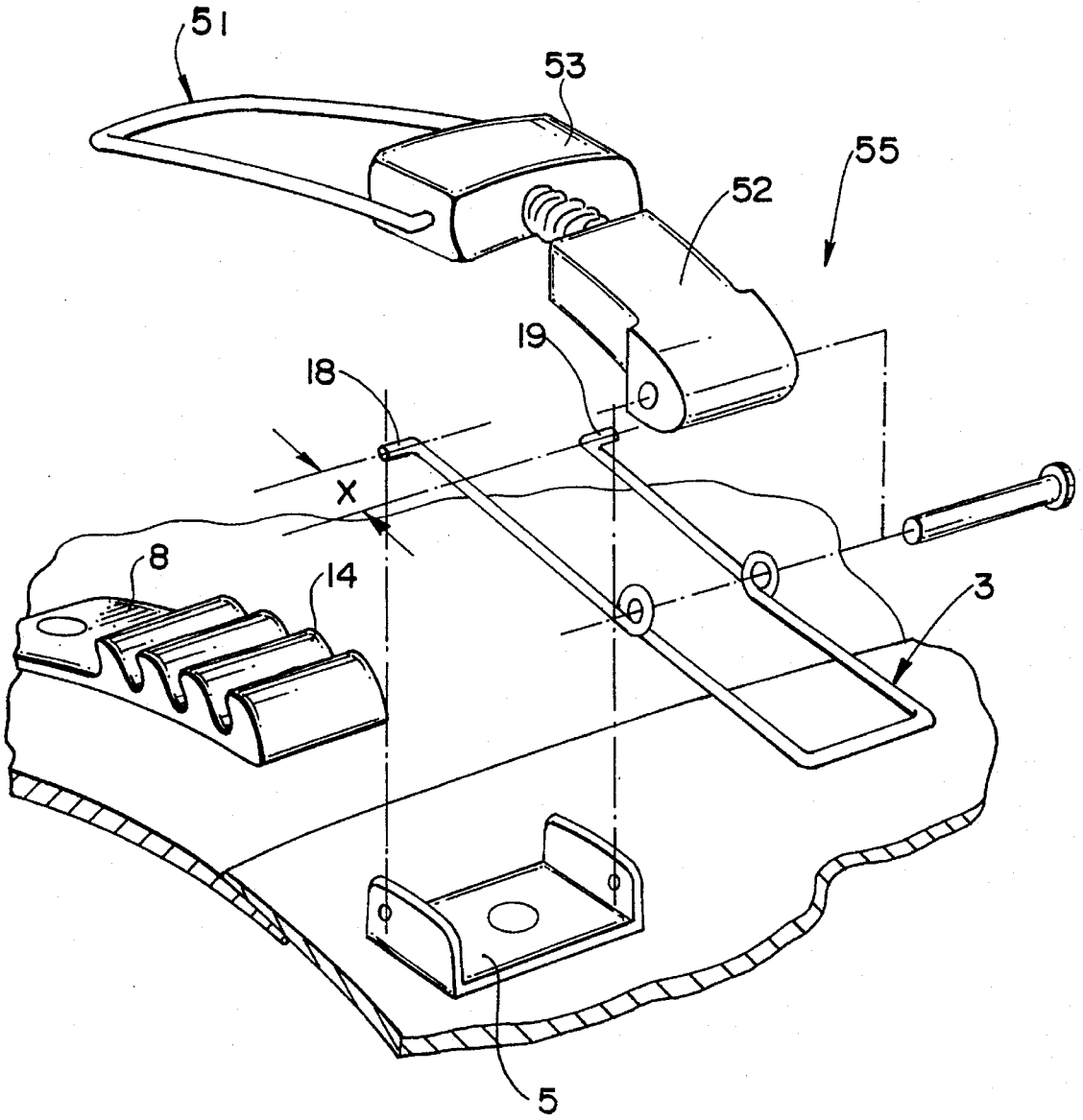
FIG. 8 illustrates another hook closure of the knuckle joint type comprising a micrometrically adjustable buckle tie rod, and in which the return means incorporated in the lever-puller interacts between the latter and its base.
Figure 9:
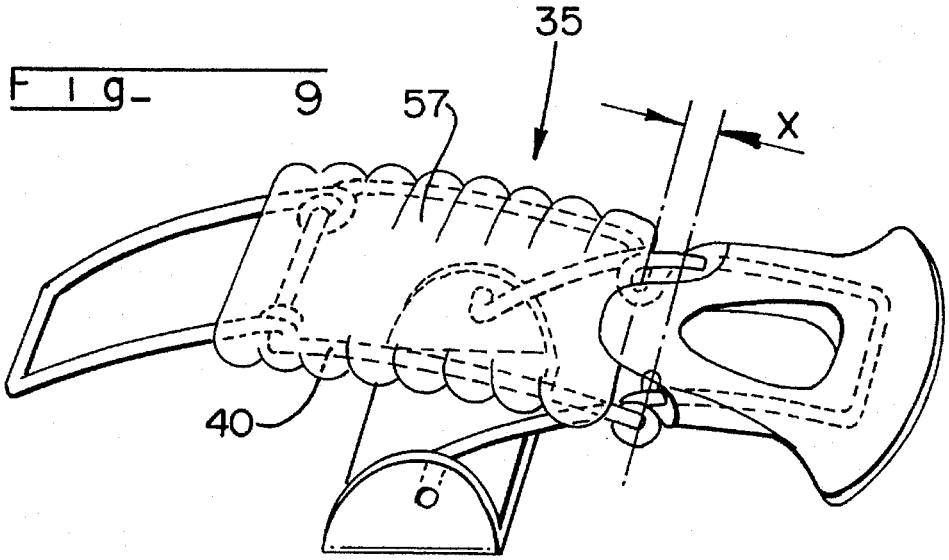
FIGS. 9–11 illustrate the adaptation of the coverings to hook closures according to the invention.

In FIG. 8, the buckle closure 55 also comprises a bolt 53-nut 53 pair which is micrometrically adjustable to position the hooking buckle 51, but in this embodiment it is the lever-puller 3 connected to its base 5 which assures the positional return function.

An advantage drawn from the integration of the elastic return function to a constituent element of the buckle closure that is obtained specifically in a flexible metallic wire is to be able to cover it to confer to it a profile, an appearance or a form adapted to the model of boot on which the buckle closure is to be mounted, this covering being able to mask at least partially the structure of the said element provided with the return function.

Figure 10:
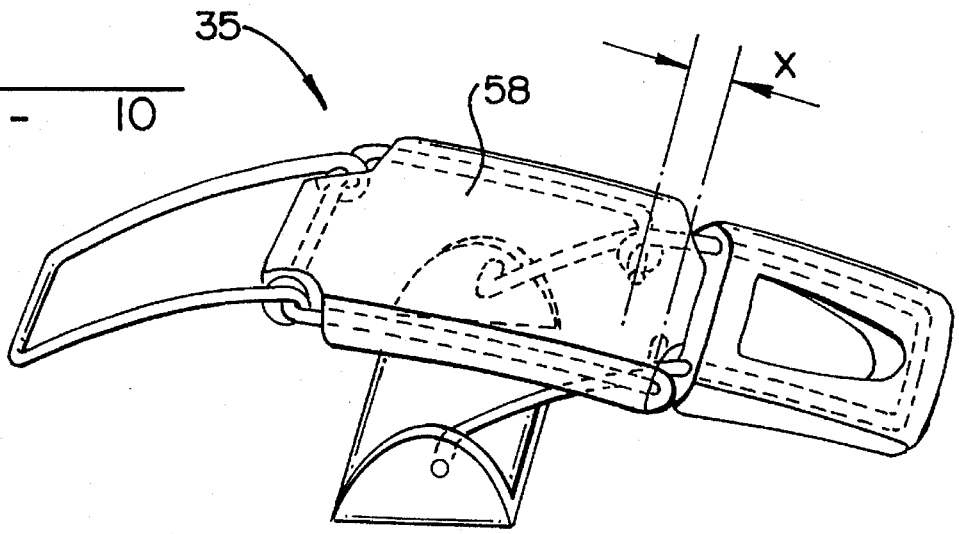
Figure 11:
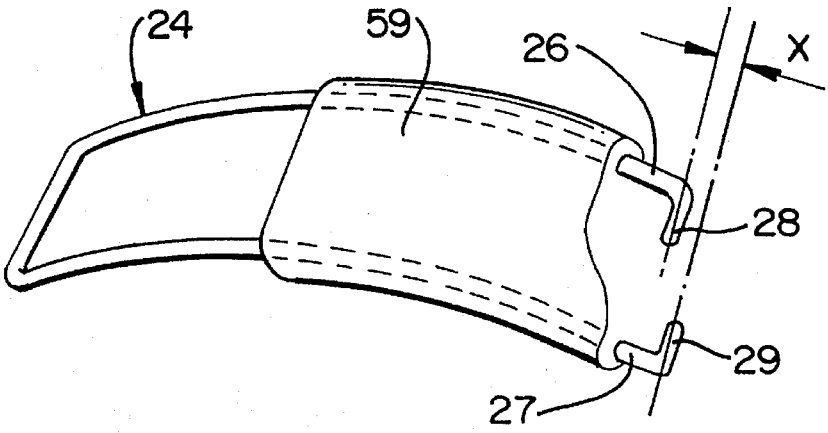

Thus, as illustrated in FIG. 9–14, one can imagine adapting a flexible sheath 57 on the tie rod 40 of the buckle closure 35 described in FIG. 5, or FIG. 10, a cap 58 for example retained by elastic pinching of the conjugated profiles. Likewise, FIG. 11, a hooking buckle 24 provided with the elastic return function can be partially overmolded along its length, the overmolding 59 being able to serve as a retention means for the curved ends 28, 29 of its arms 26, 27.

Furthermore, the overmolding and/or the covering can extend over two constituent elements of the buckle closure connected by the journal between them as long as of the constituent material of the overmolding and/or the covering is provided to be sufficiently flexible/supple so as not to interfere with the journal function.

The instant application is based upon the disclosure of French Priority Application 94.13343, filed Nov. 2, 1994, the disclosure of which is hereby incorporated by reference thereto and of which priority is claimed under 35 U.S.C. 119.

Finally, although the invention is described with reference to particular means, materials and embodiments, it is to be understood that the invention is not limited to the particulars disclosed and extends to all equivalents within the scope of the claims.

I claim:

1. Hook closure for a boot having a shell comprising on one side, a control assembly provided with an elastic means for returning to the position pressed against the shell of the boot, which assembly is constituted by a plurality of elements of which a lever-puller, a hooking buckle, and a base, connected between them by journals, and on the other side a hooking element adapted to cooperate with the buckle, at least one of the elements being obtained from a metallic wire in the form of an open buckle whose ends of the arms are curved to assure the linkage by journalling with the other elements on which it is mounted, wherein the elastic return means is integrated with one of the elements made in the form of an open buckle, which, obtained in a flexible metallic wire, has two arms of which at least one of the curved ends is offset by a value "X" and is fixed in a corresponding hole offset by the same value "X" and obtained on the other element, thus assuring the linkage by journalling between the two elements and the elastic return function thereof.

2. Closure according to claim 1, wherein the two arms are of unequal lengths, offset by the value "X".

3. Closure according to claim 1, wherein at least one of the curved ends is longitudinally offset by a value "X" by its folding at an angle different from a right angle (90 degrees) with respect to the longitudinal axis of the arm of the element of the hook closure carrying it.

4. Closure according to claim 1, wherein it is the lever-puller 3 which is made in the form of an open buckle with its ends offset which are affixed in corresponding holes of the base, thus constituting the elastic return means interacting between the lever-puller and its base.

5. Closure according to claim 1, wherein it is the hooking buckle which is made in the form of an open buckle with its ends offset, and wherein its ends are affixed in the corresponding holes of the lever-puller, thus constituting the elastic return means interacting between the hooking buckle and the lever-puller.

6. Closure according to claim 1, wherein the hooking buckle is carried by an intermediate tie rod made in the form of an open buckle with its curved ends offset which are affixed in the corresponding holes of the lever-puller thus constituting the elastic return means interacting between the hooking buckle and the lever-puller.

7. Closure according to claim 1, wherein the hooking buckle is carried by an intermediate tie rod constituted by a slide with micrometric adjustment, the hooking buckle being made in the form of an open buckle with its curved ends offset, and wherein the curved ends are affixed in corresponding holes of the tie rod, the hooking buckle thus integrating the elastic return means interacting between it and the tie rod.

8. Closure according to claim 1, wherein at least one element constituting the elastic return means receives a covering at least partially hiding its flexible metallic wire structure.

9. Closure according to claim 8, wherein the curved ends of the element constituting the elastic return means are retained in their binding holes by means of the covering.

10. Closure according to claim 1, wherein an abutment limits the possible back and forth movement of the lever-puller.

11. Closure according to claim 1, wherein the curved ends of the element constituting the elastic return means are retained in their binding holes in the base by means of a spacer.

* * * * *